US006670742B2

(12) United States Patent
Park

(10) Patent No.: US 6,670,742 B2
(45) Date of Patent: Dec. 30, 2003

(54) STRUCTURE FOR DAMPING VIBRATION OF SHADOW MASK IN FLAT CATHODE RAY TUBE

(75) Inventor: Ki Bum Park, Kyongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 48 days.

(21) Appl. No.: 09/839,168

(22) Filed: Apr. 23, 2001

(65) Prior Publication Data

US 2002/0070652 A1 Jun. 13, 2002

(30) Foreign Application Priority Data

Oct. 17, 2000 (KR) ..... 2000-61038

(51) Int. Cl.[7] ..... H01J 29/81
(52) U.S. Cl. ..... 313/402; 313/409
(58) Field of Search ..... 313/402, 403, 313/407

(56) References Cited

U.S. PATENT DOCUMENTS 4,504,764 A * 3/1985 Sakamoto et al. ..... 313/403
4,652,791 A * 3/1987 Palac et al. ..... 313/402
4,705,357 A * 11/1987 Dietch ..... 313/402
4,780,641 A * 10/1988 Hashiba et al. ..... 313/269
5,369,330 A * 11/1994 Aibara ..... 313/402
5,382,871 A * 1/1995 Funahashi et al. ..... 313/402
5,391,957 A * 2/1995 Fendley ..... 313/402
5,394,051 A * 2/1995 Lerner ..... 313/403
5,451,833 A * 9/1995 Tong ..... 313/402
5,525,859 A * 6/1996 Ito et al. ..... 313/402
6,469,431 B1 * 10/2002 Suzuki et al. ..... 313/407

* cited by examiner

*Primary Examiner*—Sandra O'Shea
*Assistant Examiner*—Dalei Dong
(74) *Attorney, Agent, or Firm*—Fleshner & Kim, LLP

(57) ABSTRACT

A structure for damping vibration of a shadow mask fitted to a mask supporting body in a flat cathode ray tube is provided. The structure includes a plurality of damper wires each fastened under tension to the mask supporting body for strapping the shadow mask between beam pass through holes in the shadow mask. The damper wires and the shadow mask are configured such that a first order natural frequency of vibration of the damper wire falls outside a range within ±10% of a third order natural frequency of vibration of the shadow mask. The structure improves vibration damping, reduces the number of required components and simplifies the fabrication process.

19 Claims, 7 Drawing Sheets

STRUCTURE FOR DAMPING VIBRATION OF SHADOW MASK IN FLAT CATHODE RAY TUBE

BACKGROUND OF THE INVENTION

1. Field of the Invention

The present invention relates to a flat cathode ray tube, and more particularly, to a structure for damping vibration of a shadow mask that selects colors in a flat cathode ray tube (CRT).

2. Background of the Related Art

The CRT is a device for actual display of an image in an image display system, and, recently, flat CRTs are developed and put into practical use, that eliminate distortion of the image, minimize reflection of external lights, and maximize a visual range. As shown in FIG. 1, the flat CRT is provided with an external structure inclusive of a substantially flat panel 1 having fluorescent material coated on an inside surface thereof, and a funnel 2 fused on a rear half of the panel 1 by using Frit glass. The panel 1 has safety glass 1*b* bonded to an external surface thereof by using resin, and there is a substantially rectangular rail 3 that supports the shadow mask fitted on the inside surface of the panel 1. The shadow mask 4 with a plurality of beam pass through holes 4*a* is fitted on the rail 3 under a tension, for selection of colors of the electron beams. There is an electron gun 6 sealed in a neck portion 2*a* of the funnel 2 for emitting the electron beams 6*a* of R, G, B three colors, and a deflection yoke 7 on an outer circumference of the neck portion 2*a* for deflection of the electron beams in horizontal and vertical directions. Though a rigidity of the shadow mask 4 can be sustained by providing a curvature to the shadow mask in the related art color CRT, as explained, the rigidity of the substantially flat shadow mask 4 in the flat CRT is relatively weakened compared to the curved shadow mask in the related art actually, which causes heavy howling, vibration of the shadow mask owing to an external acoustic wave, that deteriorates a color purity of a reproduced picture.

There are different related art methods used for preventing such a howling in the flat CRT, as one of which a structure for preventing vibration of a shadow mask by using damper wire will be explained.

Referring to FIG. 2, the related art structure for damping vibration of a shadow mask by using damper wire is basically provided with a shadow mask 4 fitted to the rail, a shadow mask supporting body, on the panel 1 under a tension, and a damper wire 8 fastened by fastening members 8*a* and 8*b* for strapping the shadow mask 4. The damper wire 8 can not be welded on the rail 3 directly owing to its thin diameter, to require the fastening members 8*a* and 8*b* for gripping both ends of the damper wire 8, then, the damper wire 8 and the fastening members 8*a* and 8*b* are welded together; the damper wire 8 is assembled with the fastening members 8*a* and 8*b* before fixed to the shadow mask 4, to require many components in the fabrication of a damping structure. For preventing a shadow of the damper wire 8 from being displayed in the picture, care should be taken in welding the damper wire 8 assembly on the rail so that the damper wire 8 is located within a narrow space between the beam pass through holes 4*a* in the shadow mask 4. For such an accurate position selection of the damper wire 8, a non-effective region of the shadow mask 4 is formed such that a hole 4*b* of a preset size is positioned on the same line with the region between the beam pass through holes in the effective areas of the shadow mask 4, for positioning the damper wire 8 with reference to the hole 4*b* by using a camera, which requires much working time in fabrication of the vibration damping structure.

In conclusion, though a plurality of damper wires 8, in more detail, damper wire assemblies, are required to be fitted through the foregoing process for obtaining vibration damping effect, as explained, many components and complicate process are required to carry out the work. The many components and complicate process drops productivity and pushes up the cost.

SUMMARY OF THE INVENTION

Accordingly, the present invention is directed to a structure for damping vibration of a shadow mask that substantially obviates one or more of the problems due to limitations and disadvantages of the related art.

An object of the present invention is to provide a structure for damping vibration of a shadow mask, which has an optimal vibration damping condition.

Another object of the present invention is to provide a structure for damping vibration of a shadow mask, which has a simple system according to the optimal condition.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the structure for damping vibration of a shadow mask in a flat cathode ray tube includes the shadow mask fitted to a mask supporting body, and a plurality of damper wires each fastened to the mask supporting body for strapping the shadow mask between beam pass through holes in the shadow mask under tension, wherein a first order natural frequency of the damper wire falls on a range outside of a range within ±10% of a third order natural frequency of the shadow mask.

The shadow mask has a thickness ranging 40 μm~80 μm, the damper wire has a diameter ranging 65 μm~100 μm, and the damper wire has a tension ranging 250 gf~1200 gf excluding the resonant tension for respective damper wire diameters.

The damper wire meets a condition of $$T < \left(\rho\left(\frac{2(L(fm))_3}{n}\right)\right)^2 (n = 1),$$

where $(fm)_n$ denotes an (n)th order natural frequency of the shadow mask, 'T' denotes a tension on the damper wire, 'ρ' denotes mass of the damper wire per a unit length, and 'L' denotes a total length of the damper wire.

The shadow mask has a thickness within a range of 50 μm~80 μm, the damper wire has a diameter within a range of 80 μm~100 μm, and the damper wire has a tension within a range of 250 gf~500 gf.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
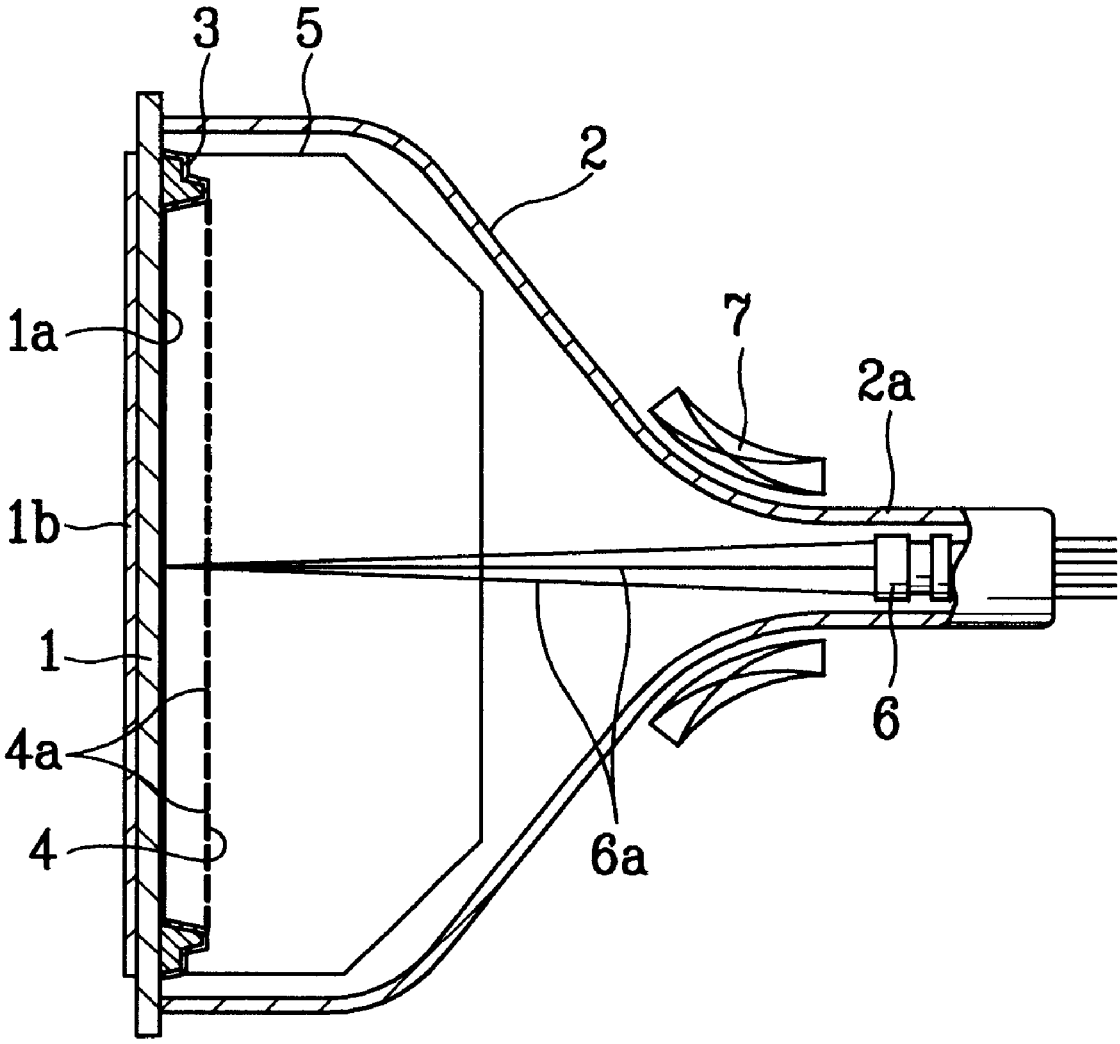
FIG.1 Related Art
FIG. 1 illustrates a longitudinal section of a related art flat cathode ray tube.
Figure 2:
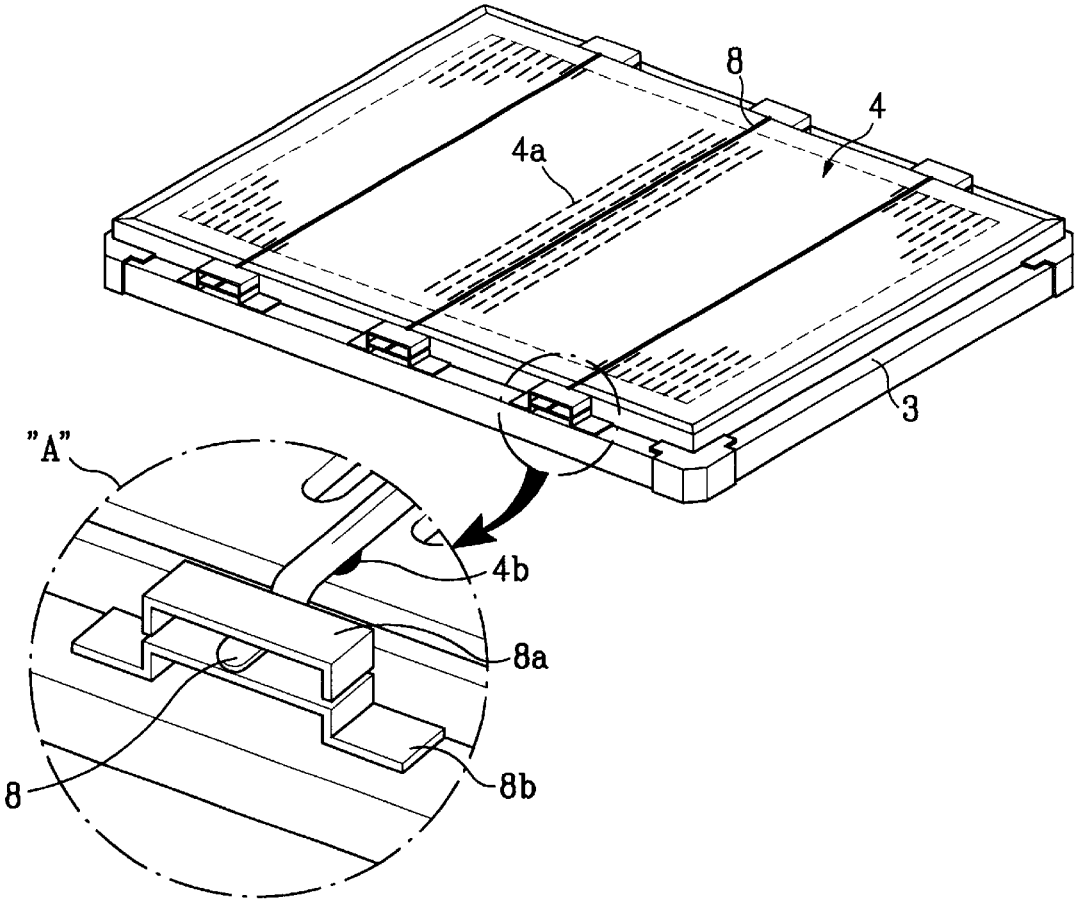
FIG.2 Related Art
FIG. 2 illustrates a perspective view of a related art structure for damping vibration of a shadow mask.

Reference will now be made in detail to the preferred embodiments of the present invention, examples of which are illustrated in the accompanying drawings. The present invention suggests calculating optimal conditions of vibration damping components for improving an anti-vibration characteristic of a shadow mask. That is, the present invention provides damper wire diameter/tension and a thickness of the shadow mask, which are optimized for vibration damping. The optimal design conditions are approximated through comparison of natural frequencies under minimum requirements for damping a vibration, and actual design criteria can be fixed by means of analyses of equivalent models.

In more detail, the minimum requirements in the present invention are set up based on a first order natural frequency of the damper wire and a third order natural frequency of the shadow mask. In addition to this, natural frequencies of the shadow masks of different thickness and natural frequencies of the damper wires of different diameters and tensions are calculated by means of natural frequency analyses, and a damper wire diameter and a tension that can generate resonance, with subsequent vibration damping effect reduction, can be predicted by comparison based on the minimum requirements. Finally, design criteria on a thickness of the shadow mask and diameter and tension of the damper wire are fixed by analyses of equivalent vibration models within a range excluding the predicted damper wire diameter and the tension.

With regard to the structure for damping vibration, when the first order natural frequency of the damper wire is within ±10% of the third order natural frequency of the shadow mask on application of an external vibration, resonance between the damper wire and the shadow mask is occurred, with significant drop of the vibration damping effect, which can be verified by experiments and analyses, and occurred in the all shadow mask specifications used actually in identical fashion. Therefore, in the minimum requirements of the present invention, the first order natural frequency of the damper wire is required to fall on ranges outside of ±10% of the third order natural frequency of the shadow mask. In other words, 10% of the third order natural frequency of the shadow mask is required to be smaller than an absolute value of a difference of the first order natural frequency of the damper wire and the third order natural frequency of the shadow mask.

In order to set up a range that meets the minimum requirements, natural frequencies of the shadow mask and the damper wire with dimensions applicable to the structure for damping vibration are calculated as follows. Since physical properties of the shadow mask differ in length and width directions thereof actually, it is difficult to calculate the natural frequency of the shadow mask by an equation, accurately. The natural frequency of the shadow mask can be predicted as an approximate solution by means of finite element method. Because the shadow mask is required to have a preset tension for maintaining thermal expansion characteristics, only a thickness of the shadow mask is taken into account in the calculation of the natural frequency. On the other hand, though the natural frequency of the damper wire can be calculated on different diameters and tensions by an equation with easy, the finite element method is used for reliability of comparison. Table 1 shows the natural frequencies of the shadow mask on different thickness.

TABLE 1

| | mask thick | | | | |
|---|---|---|---|---|---|
| natural freq. | 25 μm | 40 μm | 50 μm | 60 μm | 80 μm |
| First order (Hz) | 315 | 325 | 329 | 329 | 331 |
| Second order (Hz) | 371 | 397 | 404 | 405 | 406 |
| Third order (Hz) | 450 | 496 | 505 | 506 | 508 |

Tables 2~6 show tension vs. natural frequency of respective damper wire diameters.

TABLE 2

| | damper wire diameter 65 μm | | | | |
|---|---|---|---|---|---|
| | damper wire tension | | | | |
| natural freq. | 200 gf | 400 gf | 600 gf | 800 gf | 1000 gf |
| First order (Hz) | 347 | 512 | 635 | 738 | 828 |
| Second order (Hz) | 702 | 1033 | 1282 | 1489 | 1671 |
| Third order (Hz) | 1043 | 1537 | 1906 | 2215 | 2486 |

TABLE 3

| | damper wire diameter 70 μm | | | | |
|---|---|---|---|---|---|
| | damper wire tension | | | | |
| natural freq. | 200 gf | 400 gf | 600 gf | 800 gf | 1000 gf |
| First order (Hz) | 289 | 432 | 539 | 628 | 706 |
| Second order (Hz) | 584 | 873 | 1089 | 1268 | 1425 |
| Third order(Hz) | 867 | 1299 | 1619 | 1886 | 2119 |

TABLE 4

| | damper wire diameter 80 μm | | | | |
|---|---|---|---|---|---|
| | damper wire tension | | | | |
| natural freq. | 200 gf | 400 gf | 600 gf | 800 gf | 1000 gf |
| First order (Hz) | 243 | 372 | 467 | 545 | 614 |
| Second order (Hz) | 492 | 752 | 943 | 1101 | 1239 |
| Third order (Hz) | 730 | 1118 | 1402 | 1637 | 1843 |

TABLE 5

| | damper wire diameter 90 μm | | | | |
|---|---|---|---|---|---|
| | damper wire tension | | | | |
| natural freq. | 200 gf | 400 gf | 600 gf | 800 gf | 1000 gf |
| First order (Hz) | 206 | 324 | 410 | 480 | 542 |
| Second order (Hz) | 418 | 656 | 828 | 970 | 1094 |
| Third order (Hz) | 620 | 974 | 1231 | 1442 | 1627 |

TABLE 6

| | damper wire diameter 100 μm | | | | |
|---|---|---|---|---|---|
| | damper wire tension | | | | |
| natural freq. | 200 gf | 400 gf | 600 gf | 800 gf | 1000 gf |
| First order (Hz) | 175 | 285 | 364 | 428 | 484 |
| Second order (Hz) | 356 | 578 | 735 | 865 | 977 |
| Third order (Hz) | 526 | 858 | 1092 | 1285 | 1452 |

With regard to the calculated natural frequencies, table 7 shows damper wire diameter vs. resonant tension, as an example, for a 50 μm thick shadow mask.

TABLE 7

| Wire diameter | 65 μm | 70 μm | 80 μm | 90 μm | 100 μm |
|---|---|---|---|---|---|
| Resonant tension | 400 gf | 600 gf | 800 gf | 800 gf | 1000 gf |

That is, as shown in tables 1~6, the first order natural frequency (512 Hz) of 65 μm diametered wire damper at 400 gf tension falls on a range within a ±10%(505±50.5 Hz) of third natural frequency of a 50 μm thick shadow mask. That is, the use of the 65 μm diametered wire damper at 400 gf tension for the 50 μm thick shadow mask actually causes resonance, with a reduction of a vibration damping capability. Similarly, the 70 μm diametered wire damper at 600 gf tension (539 Hz), the 80 μm diametered wire damper at 800 gf tension (545 Hz), the 90 μm diametered wire damper at 800 gf tension (480 Hz), and the 100 μm diametered wire damper at 1000 gf tension (484 Hz) fall on the same case. Thus, by calculating natural frequency of the shadow mask and the damper wire, and applying the foregoing minimum condition, ranges of resonant diameter and tension of the damper wire for a specific thickness of the shadow mask can be predicted. Based on a prediction result, detailed design criteria for components of the structure for damping vibration of a shadow mask can be fixed by analyzing an equivalent vibration model.

Figure 3:
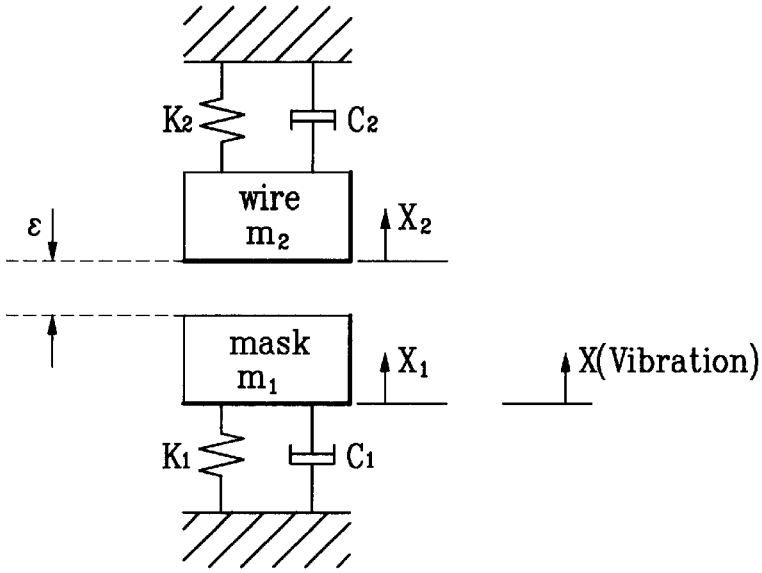
FIG. 3 illustrates a vibration analysis model of a related art structure for damping vibration of a shadow mask, schematically.

Referring to FIG. 3, in the equivalent vibration model, $m_1$ denotes mass of the shadow mask, $C_1$ denotes a damping coefficient, $K_1$ denotes a rigidity, and, similarly, $m_2$, $C_2$, and $K_2$ are defined respectively for the damper wire. '$\epsilon$' denotes a gap between the shadow mask and the damper wire, $X_1$ and $X_2$ denote respective displacements, and X denotes amplitude of applied vibration. As both the damper wire and the shadow mask are bound to the supporting structure (rail), the damper wire and the shadow mask are assumed to have one degree of freedom respectively, to use coefficients of rebound for collision between the two members during vibration. A vibration mechanism of the model defined above in actual vibration is as follows. It is assumed that the external vibration is applied to the shadow mask at first. That is, a free vibration is occurred at the shadow mask by an initial vibration, and free vibrations of the shadow mask and the damper wire are occurred by collision and rebound of the shadow mask and the damper wire. The foregoing series of events, i.e., collision, rebound and free vibration are occurred repeatedly at the shadow mask and the damper wire. A behavior of vibration damping of the shadow mask as time goes by with reference to a time the initial vibration is applied to the shadow mask in the vibration mechanism is assessed, analytically.

Figure 4A:
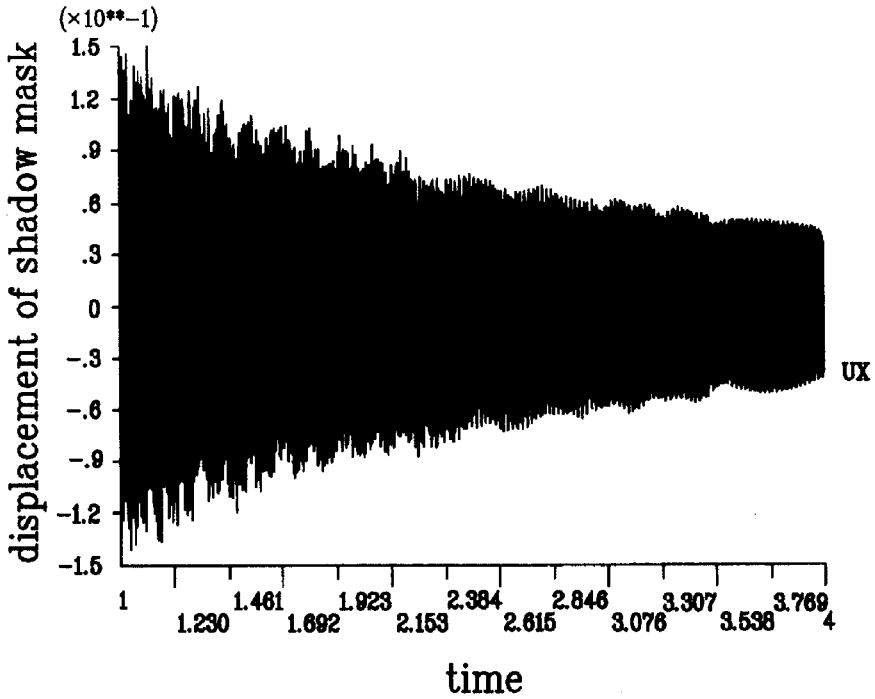
FIGS. 4A and 4B illustrate graphs showing time vs. displacement of shadow masks of different thickness upon application of vibration thereto.
Figure 4B:
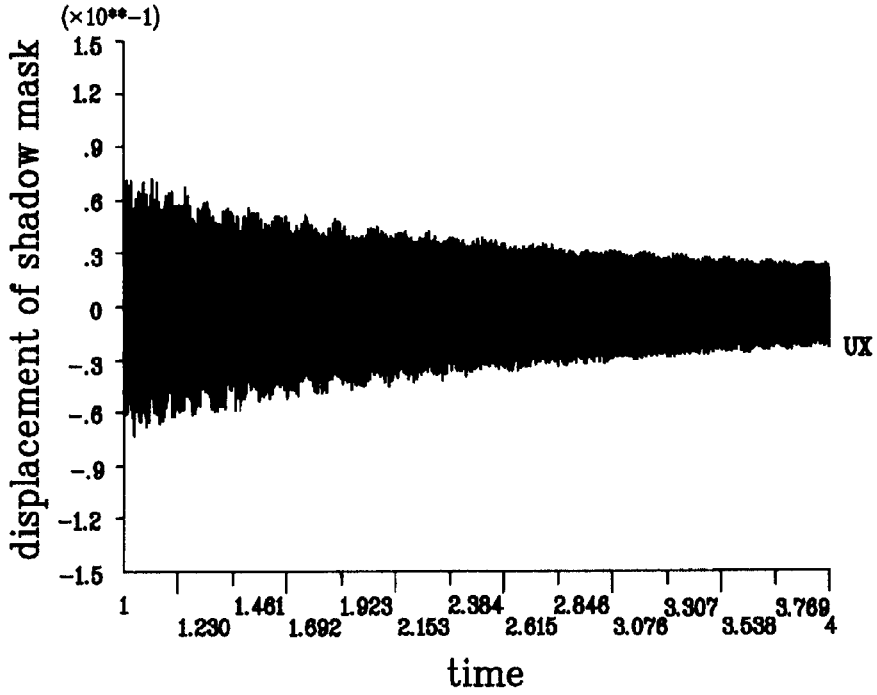

Design criteria of the shadow mask can be set up with reference to FIGS. 4A and 4B illustrating graphs showing time vs. shadow mask displacement upon application of the external vibration. FIG. 4A illustrates a result of analysis of a 25 μm thick shadow mask, and FIG. 4B illustrates a result of analysis of a 50 μm thick shadow mask, both of which use the same damper wire. Upon comparison of FIGS. 4A and 4B, it can be known that the 50 μm thick shadow mask has a relatively small displacement (i.e., a reduced vibration), and that the amount of the vibration reduction is increased continuously as the thickness of the shadow mask is increased if all the series of shadow masks of respective thickness are analyzed. Thus, though the thickness of the shadow mask can be increased for improving the vibration characteristics, it is liable that the shadow mask is torn starting from a corner of the slot because stresses on the shadow mask are asymmetry with respect to respective directions of coordinate axes. Therefore, it is preferable that the thickness of the shadow mask is set up to be below 80 μm. Meanwhile, though there is a description of the 25 μm thick shadow mask in the result of analyses, the shadow mask is required to have a 40 μm thickness minimum for providing a rigidity enough to reduce vibration. Accordingly, the shadow mask is required to have a thickness ranging from 40 μm minimum to 80 μm maximum, and the vibration damping effect is obtainable from a shadow mask with a thickness greater than 50 μm.

FIGS. 5A~5E illustrate graphs showing displacement of a shadow mask vs. tension on damper wires of different diameters, referring to which detailed design criteria of the damper wire can be obtained. FIGS. 5A~5E are graphs for damper wire diameters of 65 μm, 70 μm, 80 μm, 90 μm, and 100 μm, for identical shadow mask thickness of 50 μm, a starting point of the optimal thickness range set up before. The displacement of the shadow mask is taken after one second from the application of the vibration.

Referring to FIGS. 5A~5E, the displacements of the shadow masks are the greatest at the predicted resonant tension (diameter 65 μm—tension 400 gf, diameter 70 μm—tension 600 gf, diameter 80 μm—tension 800 gf, diameter 90 μm—tension 800 gf, and diameter 100 μm—tension 1000 gf). The displacement of the shadow mask drops in tension ranges outside of the resonant tension range. Though it is not shown, this trend is the same for entire range of the set up thickness of the shadow mask. Despite of the overall displacement reduction effect of the shadow mask, the process for adding tension is difficult owing to its own diameter in a case of the damper wire with a diameter greater than 100 μm, and in actual fitting of the damper wire, it is liable that a shadow of the damper wire is shown on the screen because the damper wire overlaps with the shadow mask beam pass through holes owing to the great diameter of the damper wire. Moreover, the damper wire with a diameter smaller than 65 μm can not withstand a tension higher than a certain value, in more detail, a tension effective for damping the vibration actually. Therefore, basically, it is preferable that the diameter of the damper wire of the present invention is set up within a range of 65 μm~100 μm. Of the displacement reduction regions, a tension below 250 gf has a low reliability of tension sustenance, and no damper wires within the set up range of diameters can withstand a tension higher than 1200 gf. Therefore, the tension is required to be within a range of 250 gf~1200 gf, excluding the resonant tension for respective diameters. The set up ranges of the damper wire diameter/tension basically meet the minimum requirements described before within the already set up range of shadow mask thickness (40 μm~80 μm), and provide an optimal vibration damping compared to the related art.

The result of analyses will be reviewed in more detail.

Figure 5A:
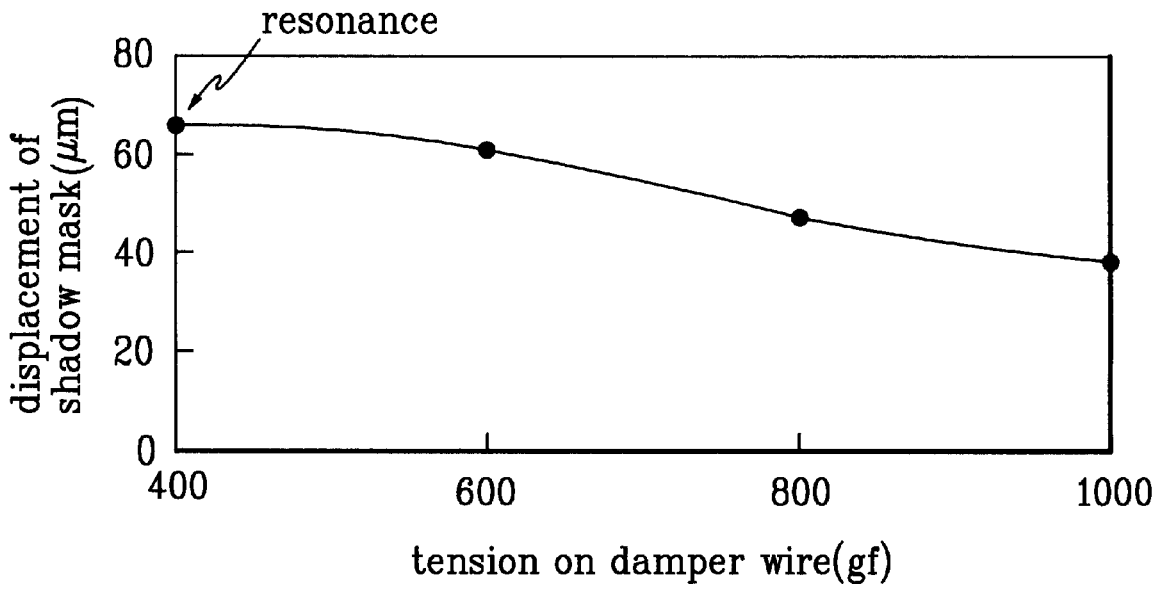
FIGS. 5A~5E illustrate graphs showing displacement of a shadow mask vs. tension on damper wires of different diameters.
Figure 5B:
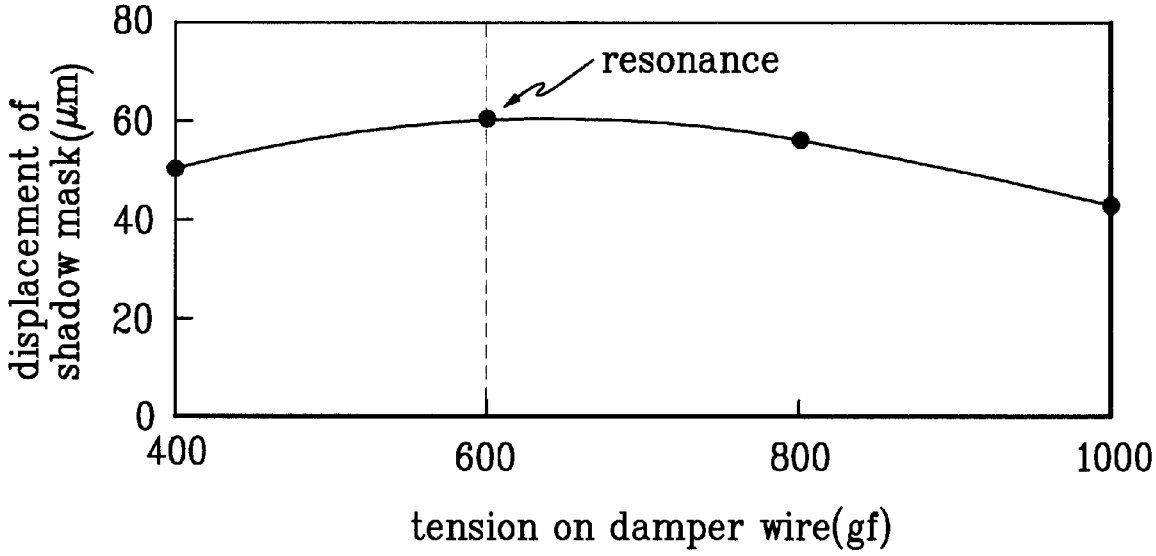

Referring to FIGS. 5A and 5B, the damper wires with 65 μm and 70 μm diameters show displacements of the shadow mask greater than other damper wires under the same shadow mask condition, in overall. That is, the damper wires with 65 μm and 70 μm diameters can not provide a great damping effect. However, the damper wires with 80 μm, 90 μm and 100 μm diameters show relatively small displacements of the shadow mask. Particularly, the displacement is reduced sharply below the range of the resonant tension substantially, and in more detail, at a tension below 500 gf, substantially. As shown in tables 1~6, the reduction range falls on a range in which the first order natural frequency of the damper is lower than the third order natural frequency of the shadow mask, substantially. Therefore, the reduction range can be expressed as the following equation (1 ), where a $(fm)_n$ denotes an (n)th natural frequency of the shadow mask, and a $(fw)_n$ denotes an (n)th natural frequency of the damper wire.

$$(fm)_3 > (fw)_1 \tag{1}$$

If it is assumed that 'T' denotes tension of the damper wire, 'ρ' denotes mass/unit length, and 'L' denotes a total length, the (n)th natural frequency of the damper wire $(fw)_n$ can be expressed in an equation (2) for natural frequency of a string as follows.

$$(fw)_n = \frac{n}{2L}\sqrt{\frac{T}{\rho}}\ (n = 1) \tag{2}$$

The reduction range can be expressed with respect to 'T' from a relation of the equations (1) and (2), as follows.

$$(fm)_3 > (fw)_1 = \frac{n}{2L}\sqrt{\frac{T}{\rho}}\ (n = 1) \tag{3}$$

$$T < \rho\left(\frac{2L(fm)_3}{n}\right)^2\ (n = 1)$$

Figure 5C:
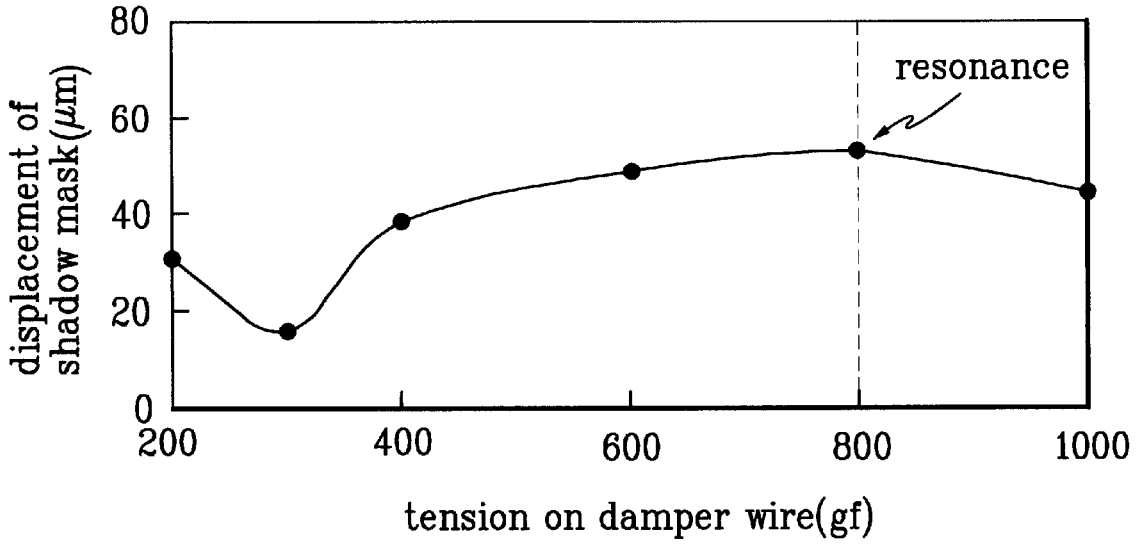
Figure 5D:
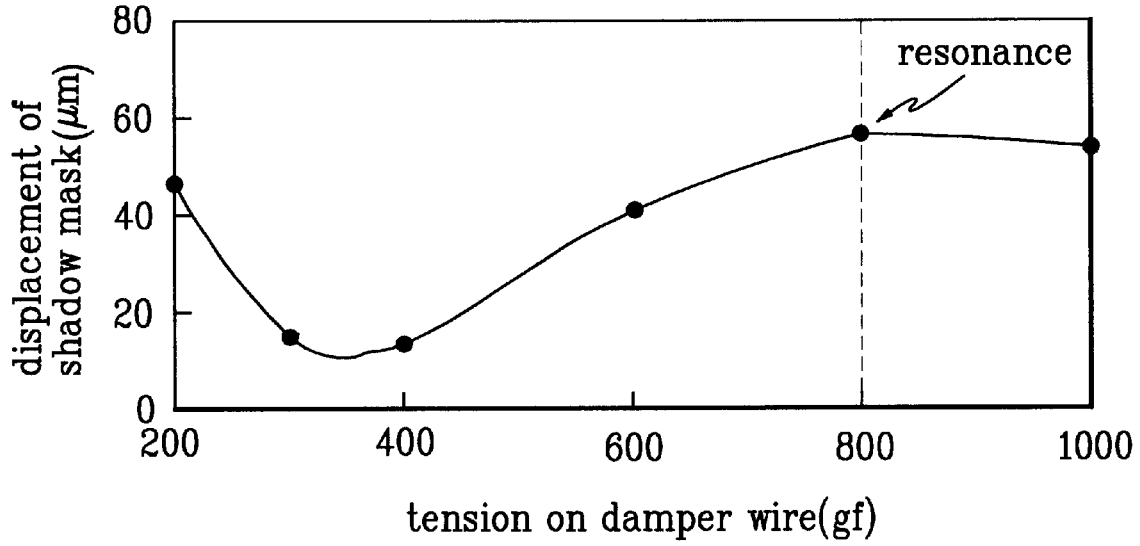
Figure 5E:
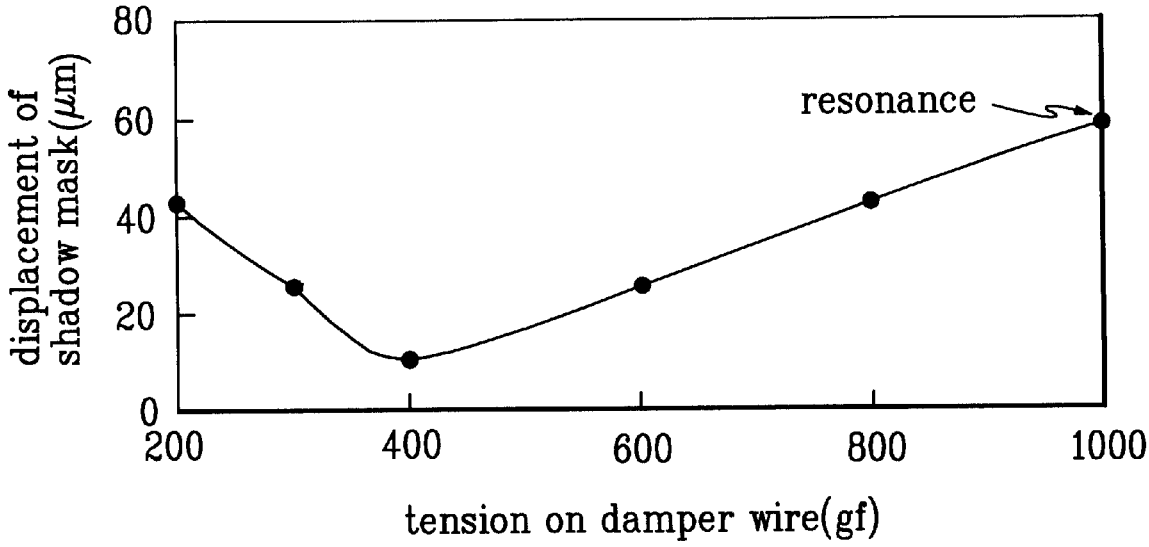

As described in association with FIGS. 5C~5E, this trend of range reduction is apparent in a case the shadow mask has a thickness of 50 μm, the damper wire has a diameter of 80 μm~100 μm at a tension of 500 gf. As can be noted in table 1, the natural frequencies are the same substantially at a thickness greater than 50 μm, of the shadow mask as far as the frequencies are in the same order. Therefore, though not shown, the trend of reduction is the same for the shadow mask with a thickness greater than 50 μm, a damper wire diameter in a range 80 μm~100 μm, and the tension in a range of 250 gf~500 gf. In conclusion, the shadow mask thickness in a range of 50 μm~80 μm, the damper wire diameter in a range of 80 μm~100 μm, and the tension in a range of 250 gf~500 gf are the most optimized design criteria for providing further improved vibration damping effect.

Figure 6:
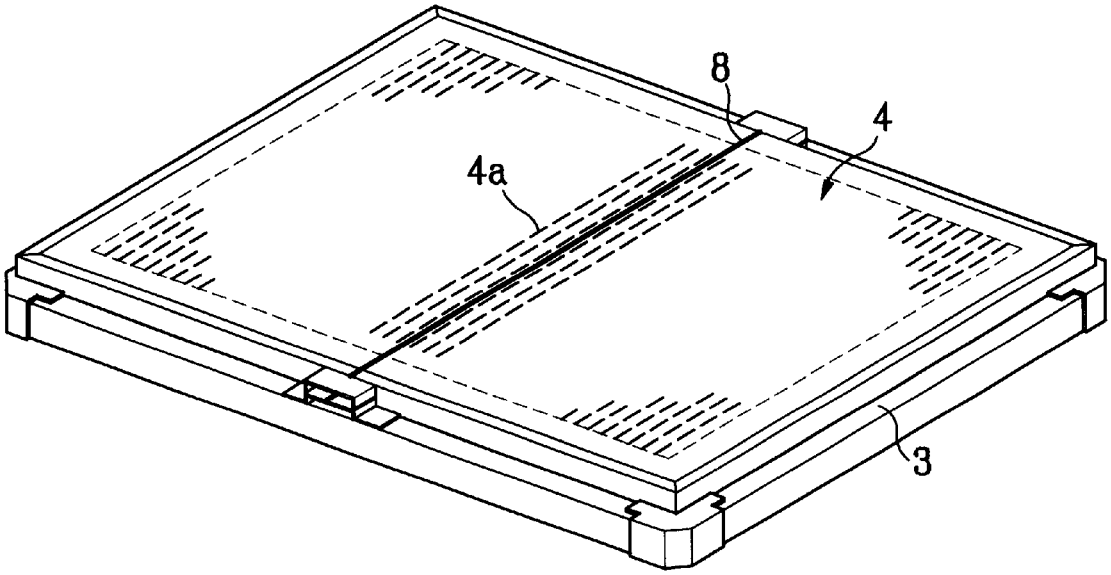
FIG. 6 illustrates a perspective view of one example of a structure for damping vibration of a shadow mask in accordance with a preferred embodiment of the present invention; and, FIGS. 7A and 7B illustrate comparative graphs showing time vs. displacement of shadow masks of the related art and the present invention upon application of vibration thereto.

Since the improvement of the vibration damping effect is expected within the set up optimal ranges, structural simplification may be taken into consideration without deterioration of the damping effect from the related art vibration damping structure. Such a simplified structure for damping vibration of a shadow mask will be explained with reference to FIG. 6. The structure for damping vibration of a shadow mask of the present invention includes a shadow mask 4 fitted to a rail on a panel 1 under tension and a damper wire 8 for strapping the shadow mask 4 by means of fastening members 8*a* and 8*b*. However, as shown in the structure for damping vibration of a shadow mask of the present invention uses only one damper wire assembly while the related art structure for damping vibration of a shadow mask uses three damper wire assemblies for adequate damping effect. According to this, the numbers of the damper wires, and the fastening members of the brackets and the plates are reduced. Moreover, the steps for positioning the damper wire, and welding can be reduced.

Figure 7A:
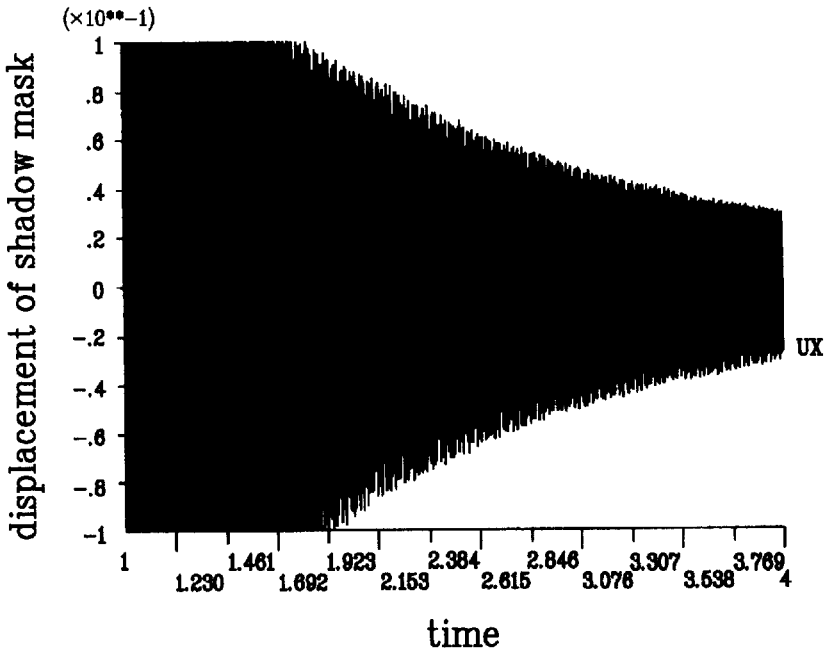
Figure 7B:
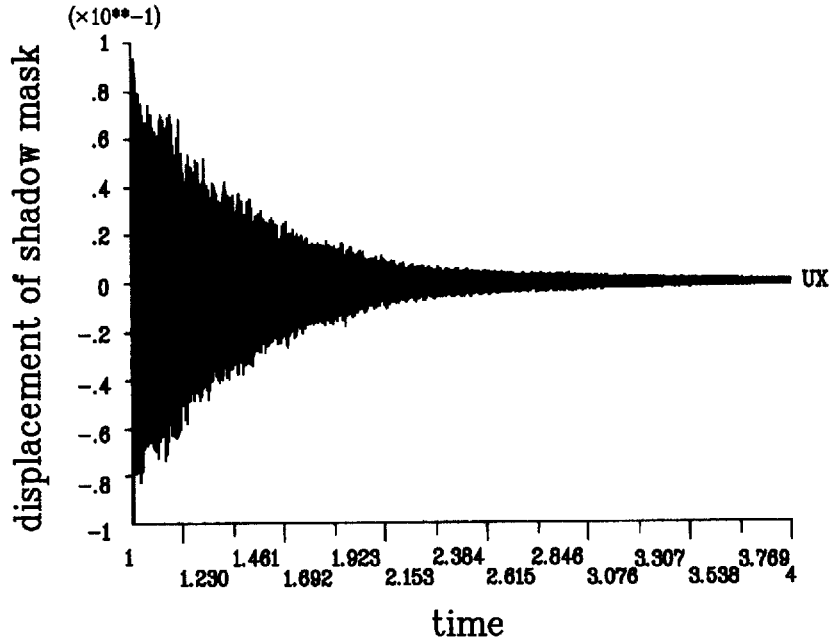

FIGS. 7A and 7B illustrate comparative graphs showing time vs. displacement of shadow masks of the related art and the present invention upon application of vibration thereto, from which a vibration damping effect of the present invention can be known. In more detail, what is shown in FIG. 7A is for the related art structure for damping vibration of a shadow mask, with a shadow mask thickness of 25 μm, and three damper wires each with a diameter 60 μm at a tension 600 gf, and what is shown in FIG. 7B is for the structure for damping vibration of a shadow mask of the present invention, with a shadow mask thickness of 50 μm, and three damper wires each with a diameter 80 μm at a tension 600 gf.

Referring to FIGS. 7A and 7B, while the related art structure for damping a vibration of a shadow mask shows vibration of the shadow mask with a great amplitude and a long duration, the structure for damping a vibration of a shadow mask of the present invention shows vibration of the shadow mask with a small amplitude and a short duration. In conclusion, the structure for damping a vibration of a shadow mask of the present invention can provide equal to, or improved vibration damping effect regardless of the simplified structure by application of the optimal design criteria.

As has been explained, the structure for damping a vibration of a shadow mask of the present invention has the following advantage.

The application of the optimal design criteria of the shadow mask and the damper wire obtained by structural analyses to the structure for damping a vibration of a shadow mask of the present invention can improve a vibration damping effect of the shadow mask. Moreover, the application of the optimal design criteria to the structure for damping a vibration of a shadow mask of the present invention permits to reduce the fabrication steps and the number of components of the structure for damping a vibration of a shadow mask without deterioration of the vibration damping effect, which improves productivity and a production cost of the CRT.

It will be apparent to those skilled in the art that various modifications and variations can be made in the structure for damping vibration of a shadow mask of the present invention without departing from the spirit or scope of the invention. Thus, it is intended that the present invention cover the modifications and variations of this invention provided they come within the scope of the appended claims and their equivalents.

What is claimed is:

1. A structure for damping vibration of a shadow mask in a flat cathode ray tube, comprising:

a shadow mask fitted to a mask supporting body and having a third order natural frequency of vibration; and at least one damper wire fastened under tension to the mask supporting body for strapping the shadow mask between beam pass through holes in the shadow mask, wherein a first order natural frequency of vibration of the at least one damper wire falls outside of a range of ±10% of the third order natural frequency of vibration of the shadow mask.

2. A structure as claimed in claim 1, wherein the shadow mask has a thickness in a range of 40 μm~80 μm.

3. A structure as claimed in claim 2, wherein the at least one damper wire has a diameter in a range of 65 μm~100 μm.

4. A structure as claimed in claim 3, wherein the at least one damper wire has a tension in a range of 250 gf~1200 gf, excluding a resonant tension.

5. A structure as claimed in claim 1, wherein a tension 'T' of the at least one damper wire is less than $\rho(2L(fm)_3)^2$, where $(fm)_3$ denotes a third order natural frequency of vibration of the shadow mask, 'ρ' denotes a mass of the at least one damper wire per a unit length, and 'L' denotes a length of the at least one damper wire.

6. A structure as claimed in claim 5, wherein the shadow mask has a thickness within a range of 50 μm~80 μm.

7. A structure as claimed in claim 6, wherein the at least one damper wire has a diameter within a range of 80 μm~100 μm.

8. A structure as claimed in claim 7, wherein the at least one damper wire has a tension within a range of 250 gf~500 gf.

9. A vibration damping structure for a shadow mask of a cathode ray tube, comprising:

at least one damper wire configured to contact the shadow mask, wherein a first order natural frequency of vibration of the at least one damper wire mismatches a third order natural frequency of vibration of the shadow mask by at least 10%.

10. The vibration damping structure of claim 9, wherein the at least one damper wire is configured to contact the shadow mask when the shadow mask vibrates more than a prescribed amount.

11. The vibration damping structure of claim 9, wherein the at least one damper wire is under a tension T, wherein $T<\rho(2L(f_m)_3)^2$ where ρ is a mass of the at least one damper wire per unit length, L is a length of the at least one damper wire, and $(f_m)_3$ is the third order natural frequency of vibration of the shadow mask.

12. The vibration damping structure of claim 11, wherein the tension T of the at least one damper wire excludes a resonant tension of the at least one damper wire.

13. The vibration damping structure of claim 12, wherein the tension T of the at least one damper wire is within a range of 250 gf to 1200 gf.

14. The vibration damping structure of claim 12, wherein a thickness of the shadow mask is within a range of 40 μm–80 μm, and a diameter of the at least one damper wire is within a range of 65 μm–100 μm.

15. A method of damping vibration of a shadow mask of a cathode ray tube, comprising:

configuring at least one damper wire to have a first order natural frequency of vibration which mismatches a third order natural frequency of vibration of the shadow mask by at least 10%; and attaching the at least one damper wire to a frame holding the shadow mask so that the damper wire crosses the shadow mask and lies between apertures of the shadow mask.

16. The method of claim 15, wherein the attaching step is performed such that the at least one damper wire contacts the shadow mask when the shadow mask vibrates more than a prescribed amount.

17. The method of claim 15, wherein the attaching step is performed such that the at least one damper wire has a tension T, wherein $T<\rho(2L(f_m)_3)^2$, where ρ is a mass of the at least one damper wire per unit length, L is a length of the at least one damper wire, and $(f_m)_3$ is the third order natural frequency of vibration of the shadow mask.

18. The method of claim 15, wherein the configuring step results in the at least one damper wire having a thickness of about 65 μm to 100 μm.

19. The method of claim 15, wherein the configuring step results in the at least one damper wire having a tension of about 250 gf–1200 gf, excluding resonant tensions.

* * * * *